US007818935B2

(12) United States Patent
Velickovic

(10) Patent No.: US 7,818,935 B2
(45) Date of Patent: Oct. 26, 2010

(54) INSULATED CONCRETE FORM SYSTEM WITH VARIABLE LENGTH WALL TIES

(76) Inventor: Pjer-Mise Velickovic, Laniste 15B, 10020, Zagreb (HR)

( * ) Notice: Subject to any disclaimer, the term of this patent is extended or adjusted under 35 U.S.C. 154(b) by 0 days.

(21) Appl. No.: 11/613,013

(22) Filed: Dec. 19, 2006

(65) Prior Publication Data

US 2007/0094974 A1 May 3, 2007

Related U.S. Application Data

(63) Continuation of application No. PCT/HR2005/000021, filed on Mar. 29, 2005.

(30) Foreign Application Priority Data

Jun. 21, 2004 (HR) ..... P 20040578 A

(51) Int. Cl.
*E04B 2/00* (2006.01)

(52) U.S. Cl. ..... 52/426; 52/309.12; 24/573.11

(58) Field of Classification Search ..... 52/426, 52/562, 309.12, 270, 309.11, 565, 563, 742.14, 52/272, 428, 442, 568, 105; 24/573.11, 453, 24/108; 248/221.11, 222.11, 222.12, 295.11, 248/297.31; 249/40, 41, 213, 214, 216, 190, 249/191

See application file for complete search history.

(56) References Cited

U.S. PATENT DOCUMENTS 2,383,864 A * 8/1945 Judkins ..... 249/217
2,948,045 A * 8/1960 Imonetti ..... 249/214
3,938,587 A * 2/1976 Vian ..... 165/76
4,239,173 A * 12/1980 Sawyer ..... 249/41
4,332,119 A * 6/1982 Toews ..... 52/481
4,617,702 A * 10/1986 Diederich, Jr. ..... 24/16 PB
4,730,422 A * 3/1988 Young ..... 52/105
4,765,109 A * 8/1988 Boeshart ..... 52/426
4,889,310 A * 12/1989 Boeshart ..... 249/41
4,916,879 A * 4/1990 Boeshart ..... 52/426
4,938,449 A * 7/1990 Boeshart ..... 249/216
5,065,561 A * 11/1991 Mason ..... 52/309.12
5,323,578 A * 6/1994 Chagnon et al. ..... 52/426
5,464,414 A * 11/1995 Cziffer ..... 606/152
5,497,592 A * 3/1996 Boeshart ..... 52/699
5,595,031 A * 1/1997 Commins ..... 52/264
5,675,942 A * 10/1997 Crawford ..... 52/127.3
5,809,725 A * 9/1998 Cretti ..... 52/426
5,809,728 A * 9/1998 Tremelling ..... 52/426

(Continued)

FOREIGN PATENT DOCUMENTS

DE 297 02 609 4/1997

(Continued)

OTHER PUBLICATIONS

International Search Report, Jul. 25, 2005 (3 pages).

*Primary Examiner*—Robert J Canfield
*Assistant Examiner*—Babajide Demuren
(74) *Attorney, Agent, or Firm*—St. Onge Steward Johnston & Reens LLC

(57) ABSTRACT

Variable length polypropylene ties are used to form an insulated concrete wall by holding sheet materials in a fixed distance part so concrete can be cast between the two sheet materials.

17 Claims, 18 Drawing Sheets

U.S. PATENT DOCUMENTS

| | | | | | |
|---|---|---|---|---|---|
| 5,813,185 | A * | 9/1998 | Jackson | 52/562 |
| 5,845,445 | A * | 12/1998 | Blackbeard | 52/426 |
| 5,852,907 | A * | 12/1998 | Tobin et al. | 52/714 |
| 5,861,105 | A * | 1/1999 | Martineau | 249/44 |
| 5,896,714 | A * | 4/1999 | Cymbala et al. | 52/426 |
| 6,240,692 | B1 | 6/2001 | Yost et al. | 52/426 |
| 6,324,812 | B1 | 12/2001 | Drya-Lisiecka | 52/783.11 |
| 6,347,435 | B1 * | 2/2002 | Davignon et al. | 24/16 PB |
| 6,351,918 | B1 * | 3/2002 | Westra et al. | 52/404.2 |
| 6,438,917 | B2 * | 8/2002 | Kubica | 52/426 |
| 6,516,498 | B2 * | 2/2003 | LaCoy et al. | 24/16 R |
| 6,588,169 | B2 * | 7/2003 | Sarver | 52/713 |
| 6,698,710 | B1 * | 3/2004 | VanderWerf | 249/216 |
| 6,704,972 | B2 * | 3/2004 | Pyle | 24/16 PB |
| 6,789,341 | B1 * | 9/2004 | Badura | 42/70.11 |
| 6,854,229 | B2 * | 2/2005 | Keith et al. | 52/428 |
| 2002/0014048 | A1 * | 2/2002 | Meendering | 52/426 |
| 2004/0129857 | A1 * | 7/2004 | Musk et al. | 249/43 |
| 2006/0123603 | A1 * | 6/2006 | Hewes | 24/16 PB |
| 2006/0185319 | A1 * | 8/2006 | Kufner et al. | 52/749.11 |

FOREIGN PATENT DOCUMENTS

| | | | |
|---|---|---|---|
| DE | 198 22 116 | | 11/1999 |
| GB | 2179990 | A * | 3/1987 |

* cited by examiner ( 3D VIEW )

( 3D VIEW )

( 2D VIEW )

( 2D VIEW )

( 3D VIEW )

( 3D VIEW )

( 2D VIEW )

( 3D VIEW )

( 3D VIEW )

( 2D VIEW )

( 3D VIEW )

( 2D VIEW )

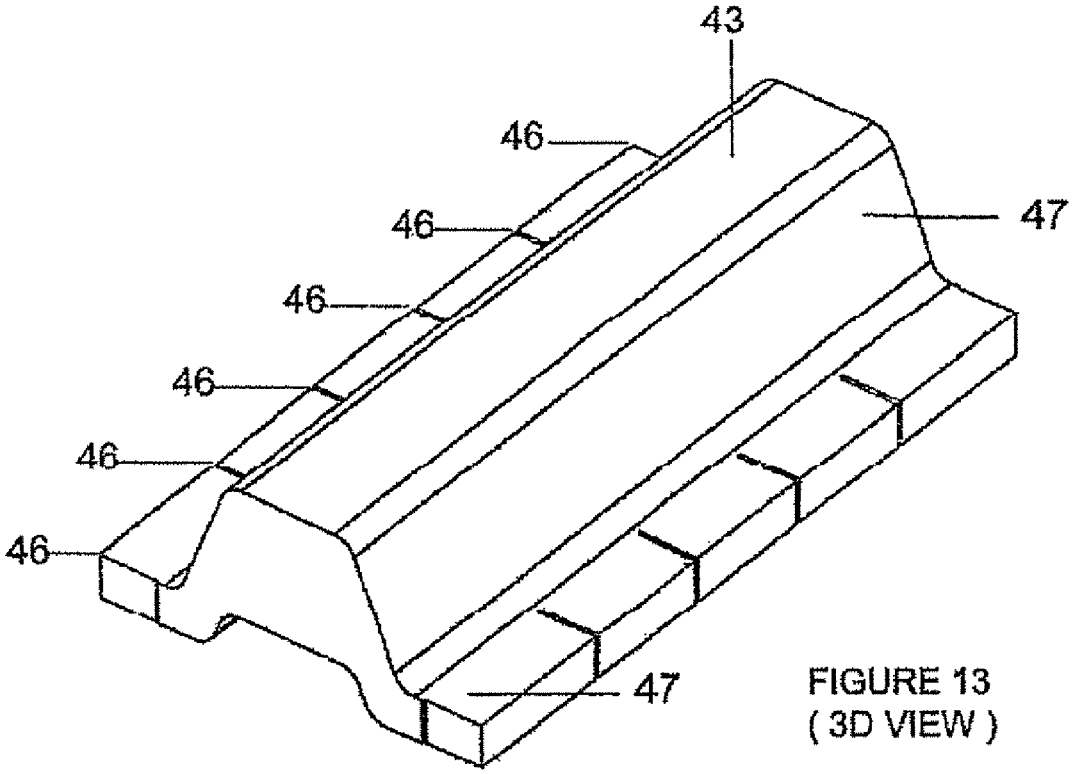
FIGURE 13
( 3D VIEW )
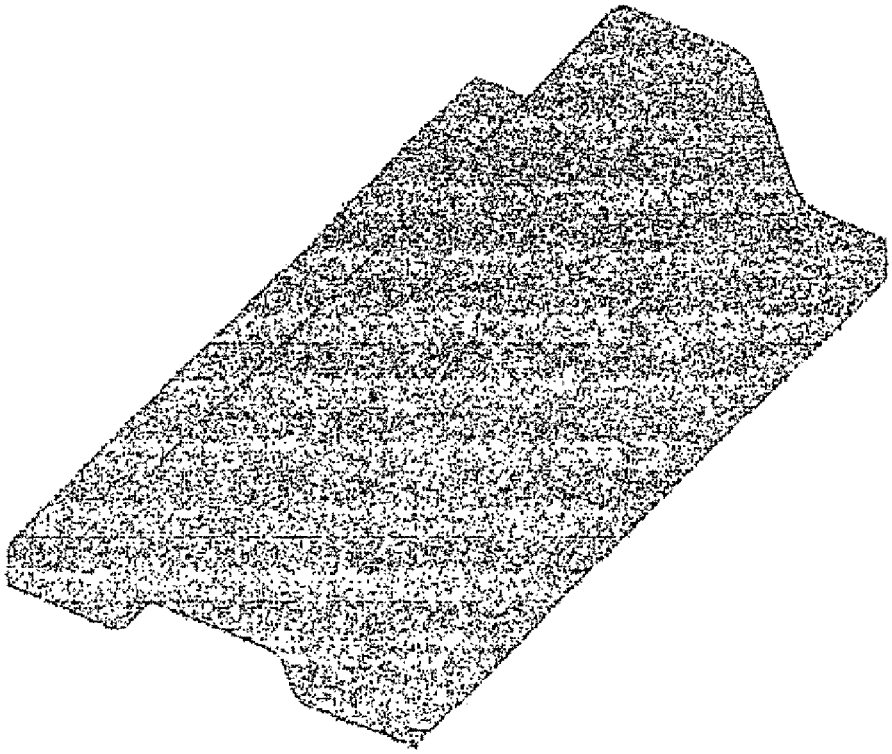

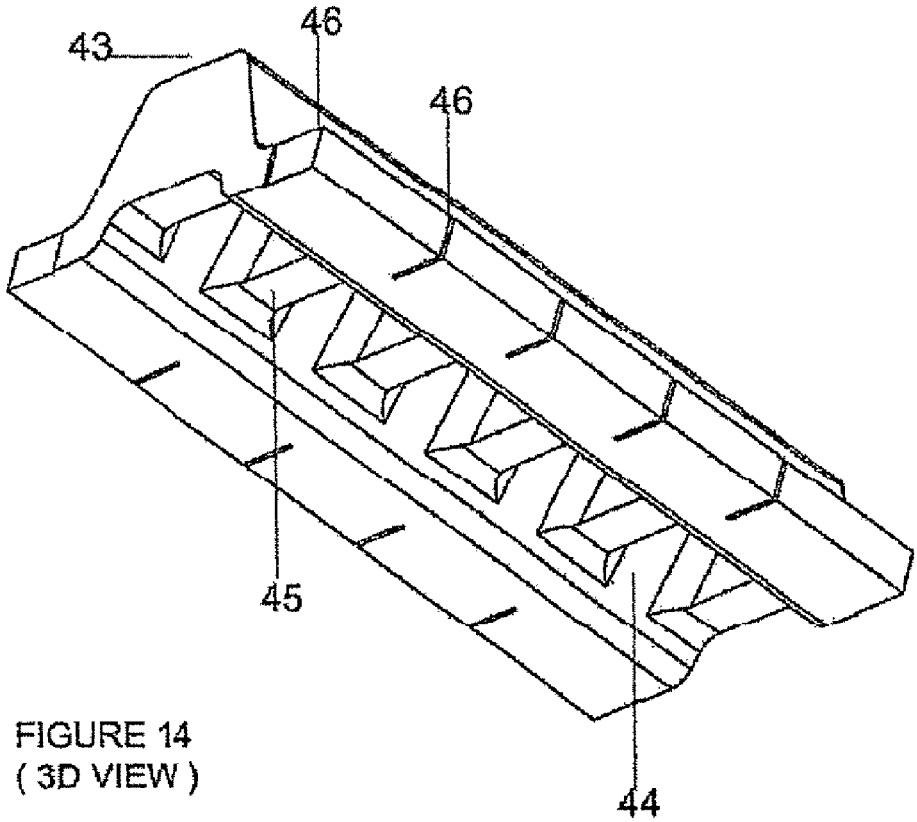
FIGURE 14
( 3D VIEW )
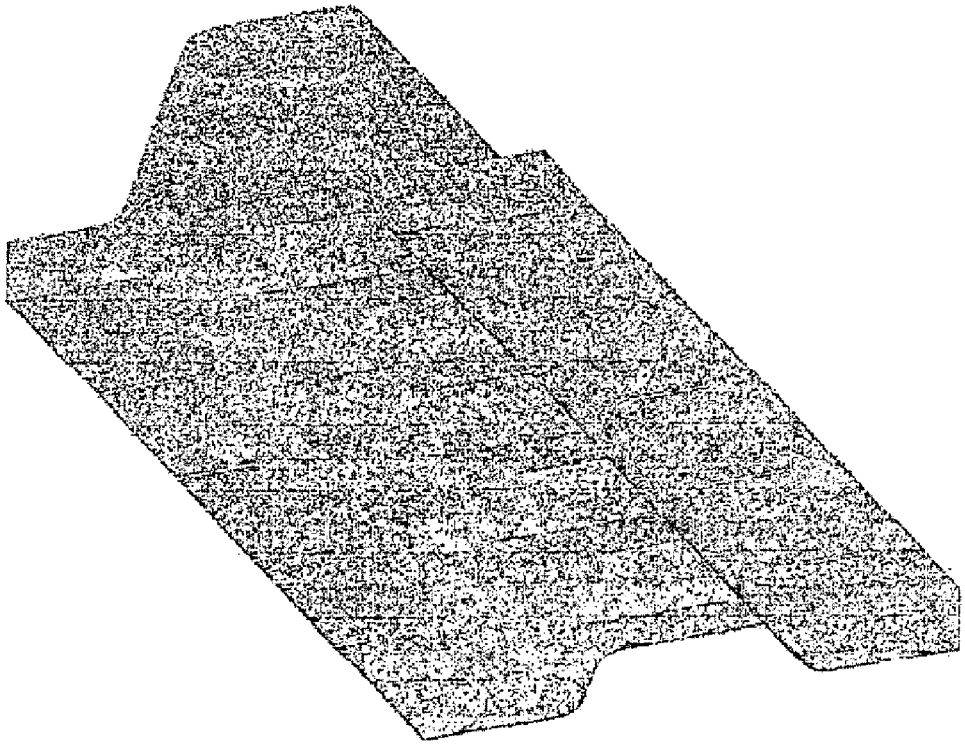

( 3D VIEW )

( 3D VIEW )

INSULATED CONCRETE FORM SYSTEM WITH VARIABLE LENGTH WALL TIES

CROSS-REFERENCE TO RELATED APPLICATIONS

The present application is a continuation of pending International patent application PCT/HR2005/000021 filed on Mar. 29, 2005 which designates the United States and claims priority from Croatian patent application P20040578A filed on Jun. 21, 2004, the disclosures of which are both hereby incorporated by reference.

FIELD OF THE INVENTION

This invention is relates to wall ties that are used in building and forming walls of various thicknesses made of insulating plates of high carrying capacity, then for placing ceiling structures between floors made of tie-lining and insulation linings of high carrying capacity, without using the classical boarding. The insulation plates and the insulation linings serve also for the thermal and acoustic insulation of walls and ceilings that are fire-resistant. According to the international patent classification (IPC) it is classified as: E 04 B, 1/49, 1/88, 5/18, 5/19, at 103:00//E04B, C 2/38, 2/52//E04G 17/065.

BACKGROUND OF THE INVENTION

The building of concrete walls at family, residential and industrial objects conventionally requires the use of boarding to cast the walls. Boarding is typically made of wooden material or of metal plates. Boarding is placed before concreting the walls and then dismounted after the concreting of the wall is terminated. These assemblies can be expensive, they often require the use of a crane and other heavy equipment. After the wall concreting it is necessary to insulate the walls. The reinforced concrete plates often required boarding or a lining made of bricks. The weight of the brick lining increases the plate thickness and weight. All these materials, their transport, the use of various heavy building machines were rather expensive and slow.

Civil engineers have tried up to now to make easier and cheaper the building of objects, with more or less success. Many solutions of this problem have been proposed, and many of them use the wooden or a metal boarding. In several known solutions it was tried to pour concrete directly into styrofoam blocks. These blocks are complicated to transport to the building-site. This building system is called "the igloo system".

Most of these systems required a set of metal bars that would be adjusted to a desired thickness by a screw. Some have cast the distancing members that kept the boarding on a foreseen distance. All these systems required additional efforts at standing the walls and dismounting the boarding.

SUMMARY OF THE INVENTION

The primary scope of the invention is to improve, make it easier and cheaper as well as to accelerate building of a structure. By using the variable ties for connecting the insulation plates to a desired spacing. To enable the building of various wall shapes, angles of 90°, angles of 135°, T-forms, rounded wall shapes. The insulation plates become a firmly fixed boarding for the concrete wall. By using the ties-linings and the insulation linings it is possible to construct reinforced concrete plates in an easier, faster and simpler way. The insulation lining is lighter than the lining made of bricks and much better concerning the acoustic and thermal insulation as well as the fire protection. It does not require either any boarding and a lot of supporters or substantial man power to construct. The secondary scope of the invention is to enable a further use of the variable ties and of the ties-linings in concrete walls and ceilings in all finishing working phases. They are used as the distancing members and the carriers of the mounting. Also, the variable ties are quality used at carrying-out the installation and finishing works on the object. Their little feet serve instead of the carriers for plaster plates. The present invention provides a faster, cheaper and better building of objects.

A further aspect of the invention is a method to pour concrete all at once up to the height of the first reinforced concrete plate by the clever use of these variable ties and insulation plates. Then, for standing the reinforced concrete ribbed plates by means of the ties-linings and insulation linings, without the boarding and a lot of supporters. The entire materials are light for transportation and transfer to the installing location; they do not require the use of heavy machines. And, they are used in all stages of the work and building of the object.

The additional scopes and advantages of the invention will partly be presented in the following description and partly will be learned through the invention application. There are three types of variable ties for the insulation walls: straight, for the 90° angle, for the 135° angle, and there is also the cross tie for the formation of various T-forms of the concrete wall. The straight variable ties serve for the formation of different thicknesses of straight concrete wall. They consists of two parts, the male and the female one. They can be placed very fast and easily on the desired wall thickness according to the design of the object. The variable ties for the formation of the concrete wall under the angle of 90°. They also consist of two parts, the male and the female tie. Also, they can be easily placed on a necessary wall thickness according to the design of the object. The variable ties for the formation of the concrete wall under the angle of 135° also consist of two parts. Of the male and female part that can be easily and fast placed on the wall thickness according to the design of the object. The cross tie enables the formation of T-shape of the wall of different thickness. They are used in the combination with two parts of the male angular tie of 90° and the male straight tie. In such a way, any requirement in accordance with the design of the object can be accomplished. There is the possibility of the formation of rounded concrete walls of different thicknesses with the straight variable ties. The advantage is given also to the light material of which the ties are made.

The variable ties are placed at a horizontal spacing of 25 cm and at a vertical spacing of 25 cm. The variable ties for angles of 90° are placed from the very bottom of the object at every 25 cm vertically. The variable ties for angles of 135° are also placed from the bottom of the object wall at every 25 cm vertically. The variable ties at the rounded wall are placed along the horizontal line of the outer and inner side of the wall, between the wooden guides set on the foundation of the object. The spacing between the variable ties depends on the width of the insulation wall.

The advantage of the variable ties is in the possibility of a firm fixing to a desired thickness. This is achieved by means of the lateral teeth on the male part of the tie and the lateral teeth on the female part of the tie. The shape and the form of the variable ties and their way of fixing satisfy the tensile strength anticipated by the law. The ties-linings are constructed with the distancing members to the bars of the mounting of the ribs of the carrier of the reinforced concrete plates and with the grooves for the insulation lining. The ties-linings are placed into the grooves on the lateral sides of the lining, on every 18 cm. The outer little feet of the tie-lining serve instead of the carriers for the plaster plates on the ceiling. They are anchored and fixed into the reinforced concrete plate.

A polypropylene material, PP Vestolen P 7032 (h210), which is very strong and suitable for an economical production and satisfies the regulated tensile strength, is used for the production of the variable ties and the ties-linings.

The insulation lining is constructed in such a way that it can carry the load of the mounting and of the casting of the liquid concrete. It is made of the same material as the insulation plate. The insulation linings are connected mutually by means of the ties-linings. The mounting of the carrier is set on the tie-lining, which is in the same time the distancing member of the mounting. This construction is several times lighter than all the others. It is better insulated acoustically and thermally than the reinforced concrete plates with the brick lining. Also, through the insulation lining it is possible to cut in the channels for the electrical and other necessary installations.

The working tool at the installing of the insulation lining and insulation plates consists of the hand saw for cutting foam insulation, pincers and a hot cutter for forming the channels in the insulation plates and in the insulation linings for introducing the necessary installations.

Self-extinguishing insulating foam sheet materials of high carrying capacity are used for the insulation plates and the insulation linings. Preferably, they are e steam-permeable according to DIN 4102-B1, EUROCLASS E and ONROM B 3800 BI, and comply with the corresponding standards SIST EN 13163, DIN 18164, ONROM 6050 and HRN G. C7.202. Three kinds of insulation plates are used: for the thermal insulation on the places with the increased humidity and the increased mechanical loading, for the thermal insulation of the underground objects, and for the thermal and acoustic insulation on the places where a high carrying capacity is demanded. It is also used for the insulation linings. The density of the insulation plates and of the insulation linings makes 30-35 kg/m2, the coefficient of the diffusion resistance of the steam makes from 40 to 100. The thermal resistance RI per 1 m2 K/W makes 1.71 and the compressive hardness at 10% of deformation makes less than 0.15 n/mm. The material of the insulation plate and of the insulation lining is not harmful for the health and for the environment, not resistant to organic dissolvers. It creates a comfortable microclimatic atmosphere of living in winter and in summer, and it achieves great energy savings for the cooling and heating of all inner accommodations in the object.

BRIEF DESCRIPTION OF THE DRAWINGS

FIG. 13 presents a perspective drawing and the view of the outer part of the insulation lining for the reinforced concrete plate.

FIG. 14 presents a perspective drawing and the view of the inner part of the insulation lining for the reinforced concrete plate.

A short description of the elements of the variable ties and on the cross follows.

Element 20 presents the wall on the variable tie that enters into the groove in the insulation plate.

Element 21 presents the male part of the variable tie.

Element 22 presents the female part of the variable tie.

Element 23 presents the distancing member of the horizontal mounting, the span from the end of the wall to the bars.

Element 24 presents the view of the lateral teeth on the male parts of the variable ties.

Element 25 presents the part on the female tie, where the male tie is fixed.

Element 26 presents the part on the male part of the variable tie, where the span measures are signed.

Element 27 presents the little feet on the variable ties and on the ties-floors that serve for fixing the plaster plates to the wall.

Element 28 presents the reinforced part of the male part of the angular tie of 90°.

Element 29 presents the reinforced part of the female part of the angular tie of 90°.

Element 30 presents the part of the female part of the angular tie of 90°, where the mail part of the tie is fixed.

Element 31 presents the place of the male part entrance into the female reinforced part of the angular tie of 90°.

Element 32 presents the neck of the angular male tie of 135°, which can be cut to the measures if necessary.

Element 33 presents the reinforced part on the male part of the angular tie of 135°.

Element 34 presents the reinforced part on the female part of the angular tie of 135°.

Element 35 presents the place, where the male angular tie of 135° is fixed to the female part.

Element 36 presents the part on the tie female part, where the surplus of the tie female part can pass.

Element 37 present the places on the cross tie, where the male angular ties of 90° enter Element 38 presents the place, where the male angular tie of 90° is fixed.

Element 39 present the part of the cross tie, where the variable straight male ties enter.

Element 40 presents the part of the cross tie, where the variable male straight tie is fixed.

Element 41 presents the walls on the tie-lining that enters into the grooves on the insulation lining.

Element 42 presents the distancing member on the tie-lining for the mounting bars of the carrier into the reinforced concrete plates.

Element 43 presents the outer surface on the tie-lining, where the concrete is layered.

Element 44 presents the inner surface of the tie-lining, the cavities.

Element 45 presents the inner ribs—the reinforcement of the insulation lining.

Element 46 presents the slots in the insulation lining, where the ties-linings enter.

Element 47 presents the lateral outer wings of the insulation lining that are used as the boarding of the reinforced concrete carriers.

Element 48 presents the anchors for fixing the ties-linings in the reinforced concrete plate.

DETAILED DESCRIPTION OF THE INVENTION

Figure 1:
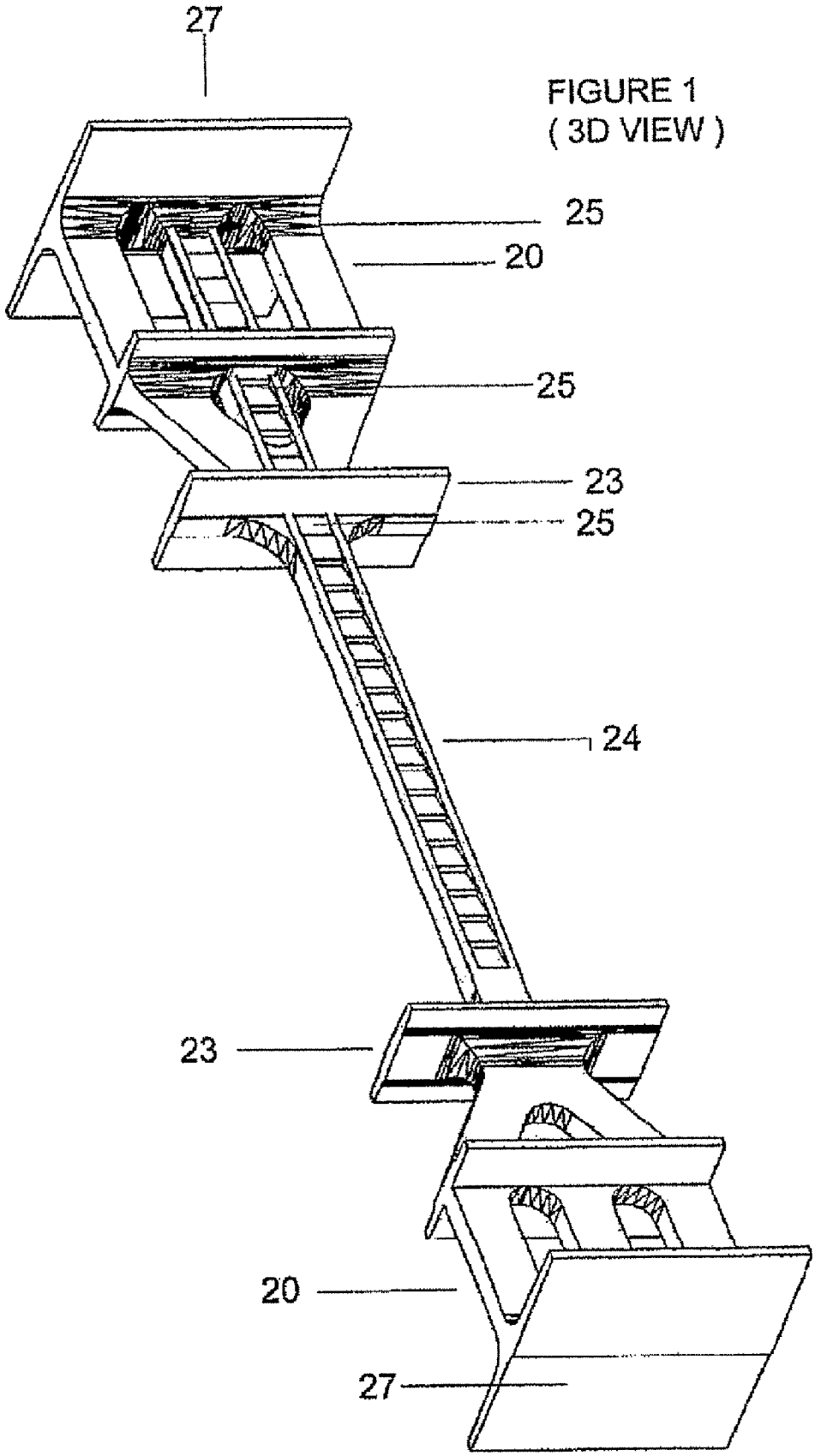
FIG. 1 presents a perspective drawing of the straight folded variable tie.
Figure 2:
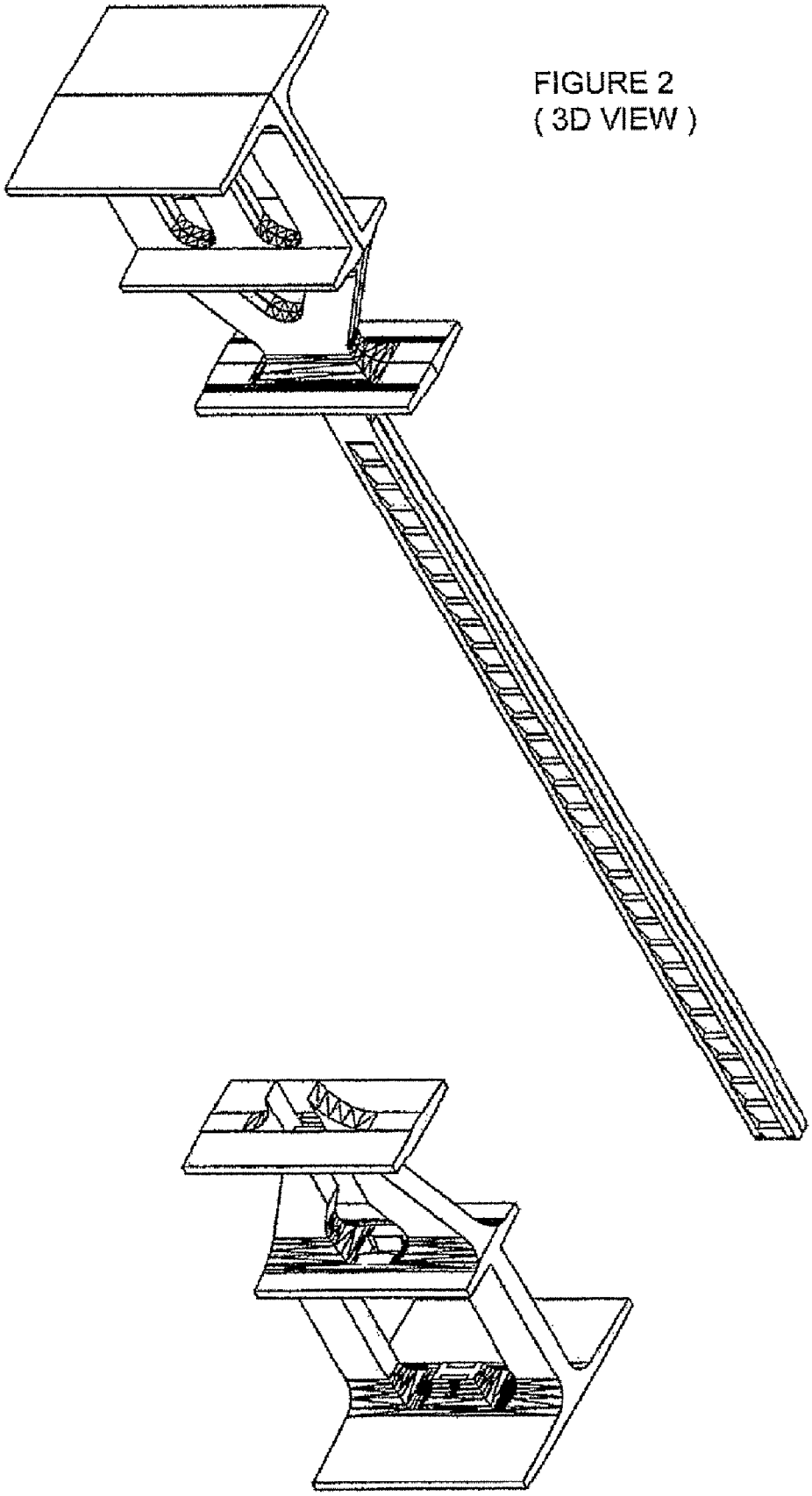
FIG. 2 presents a perspective drawing of the male and female part of the straight tie.
Figure 3:
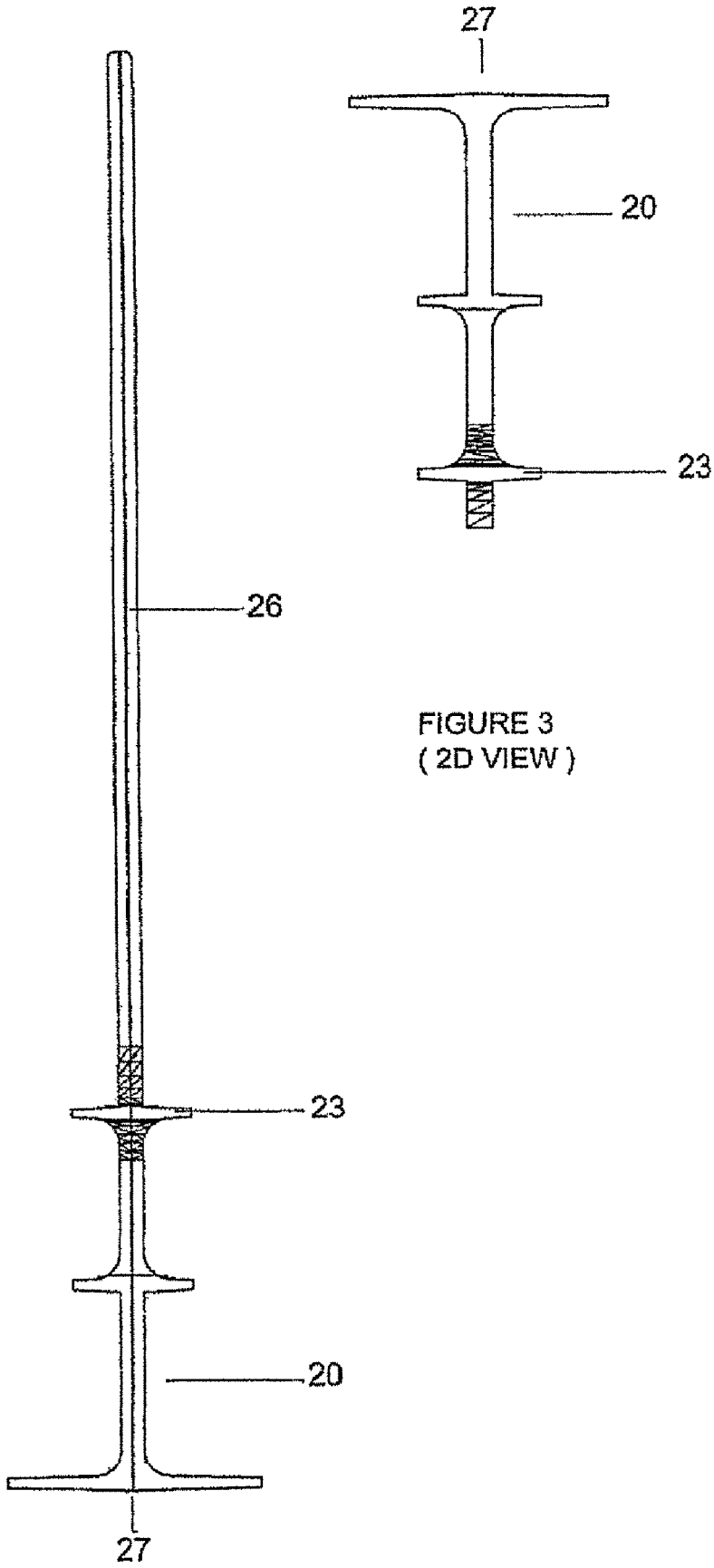
FIG. 3 presents the top view of the male and female part of the straight tie.
Figure 4:
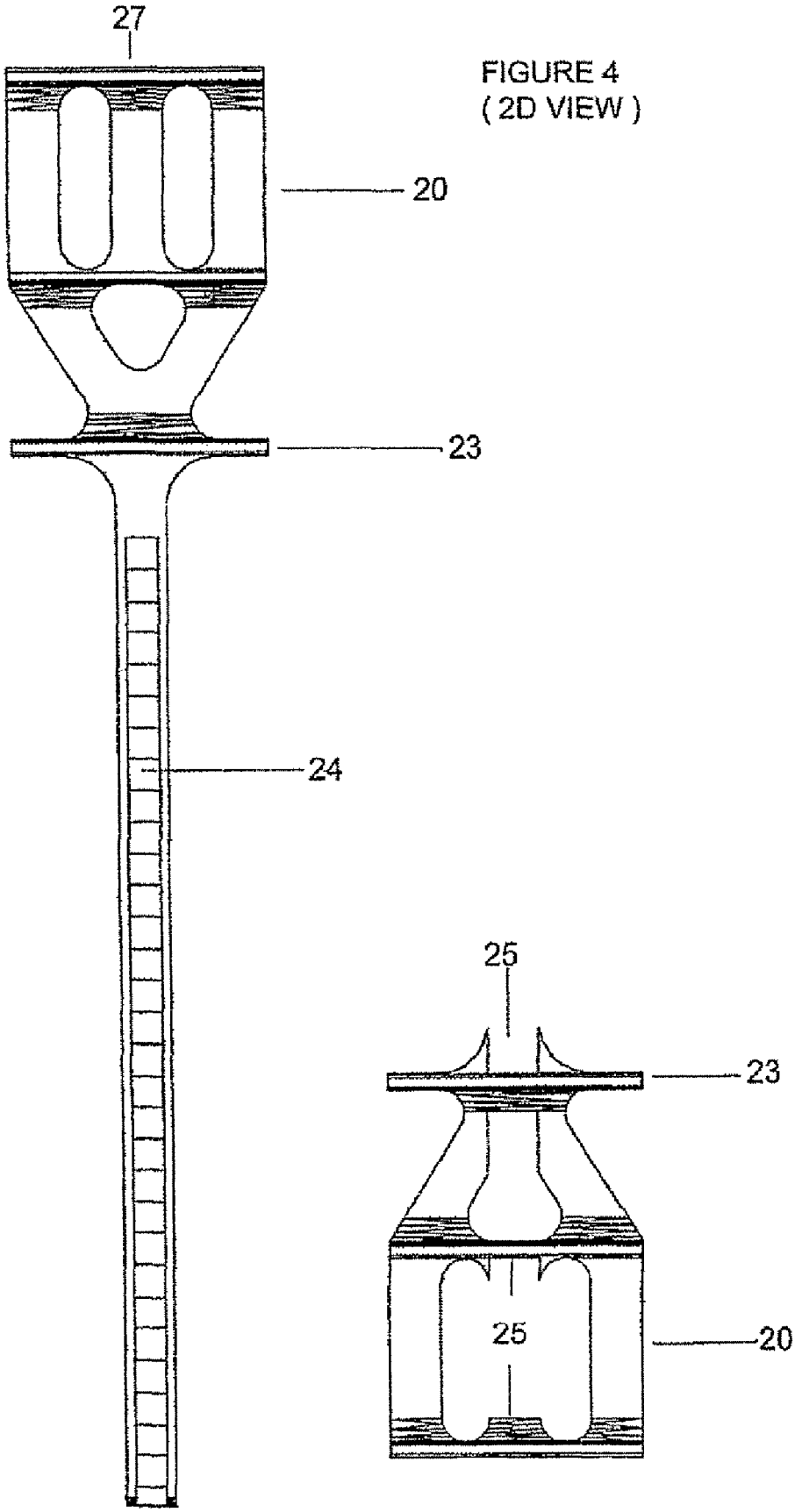
FIG. 4 presents the side-view of the male and female part of the straight variable tie.
Figure 5:
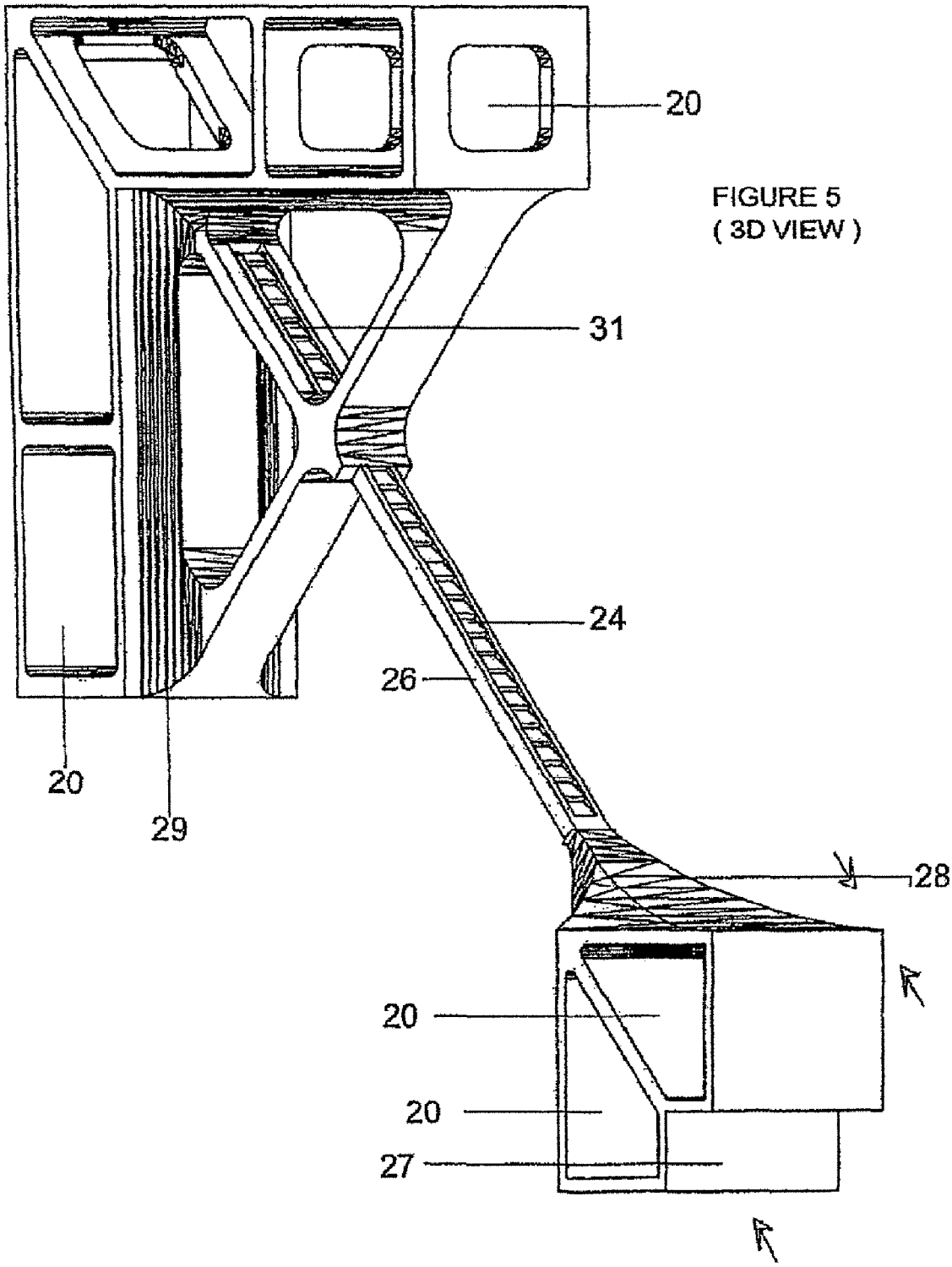
FIG. 5 presents a perspective drawing of the folded variable angular tie of 90°.
Figure 6:
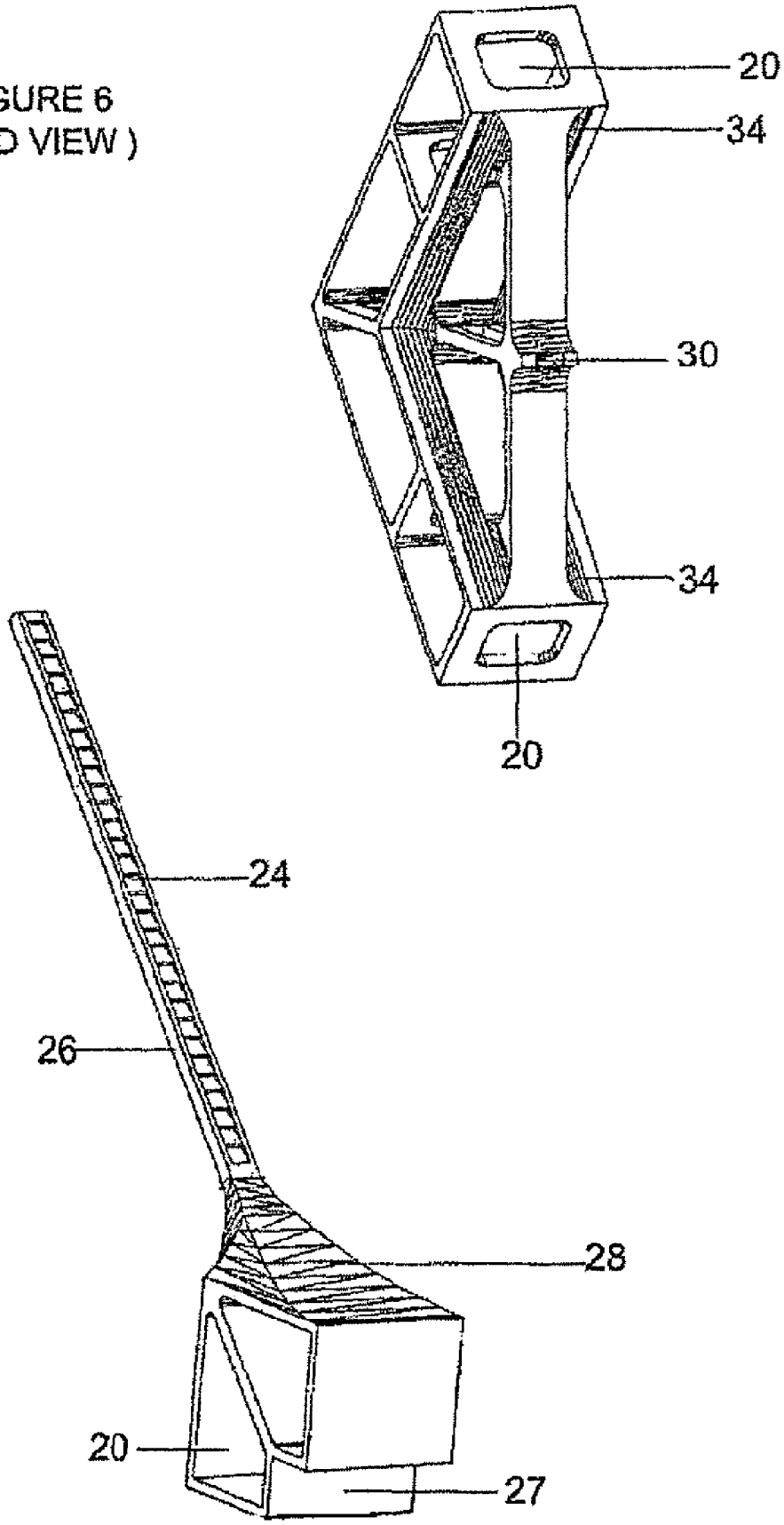
FIG. 6 presents a perspective drawing of the male and female part of the angular tie of 90°.
Figure 7:
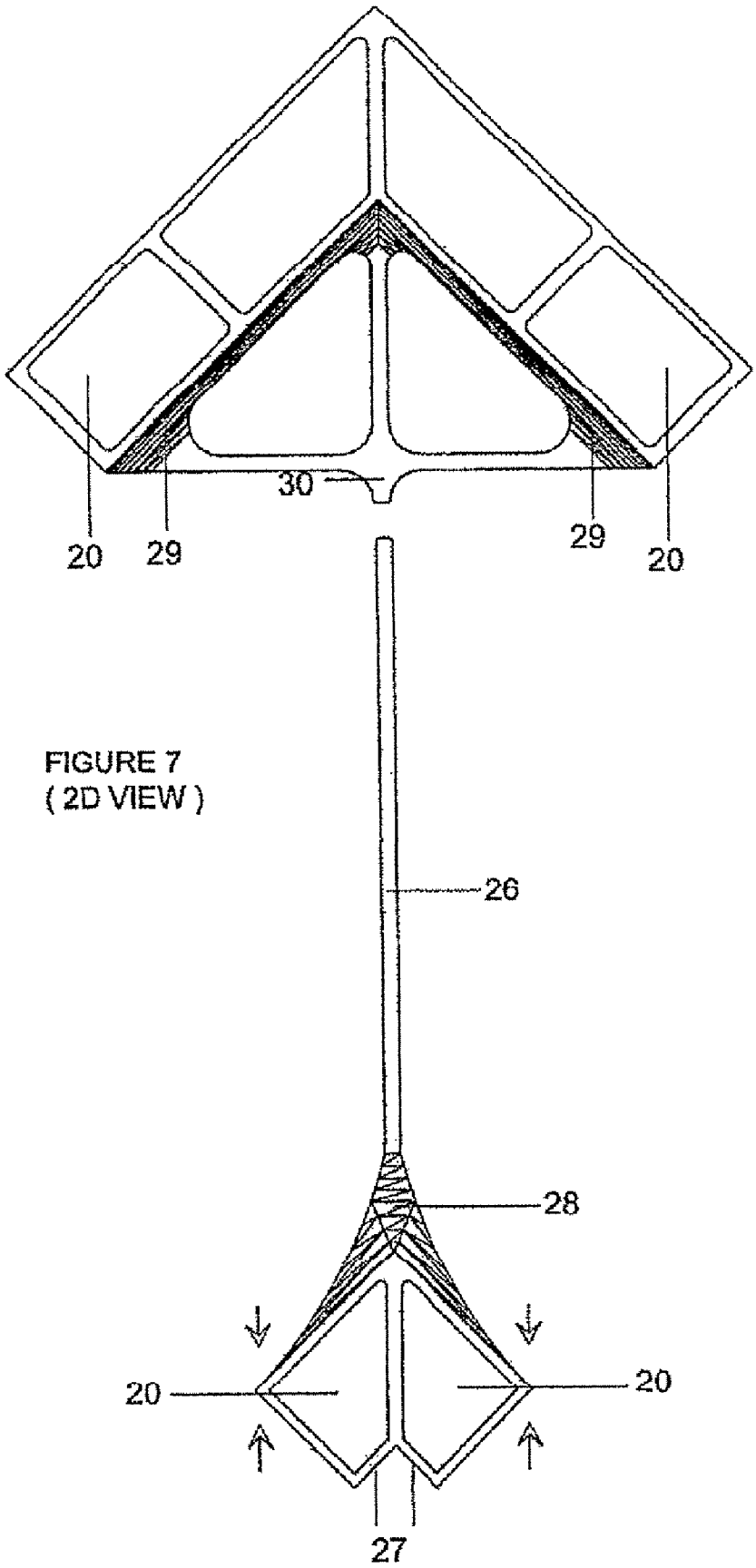
FIG. 7 presents the top-view of the male and female part of the angular tie of 90°.
Figure 8:
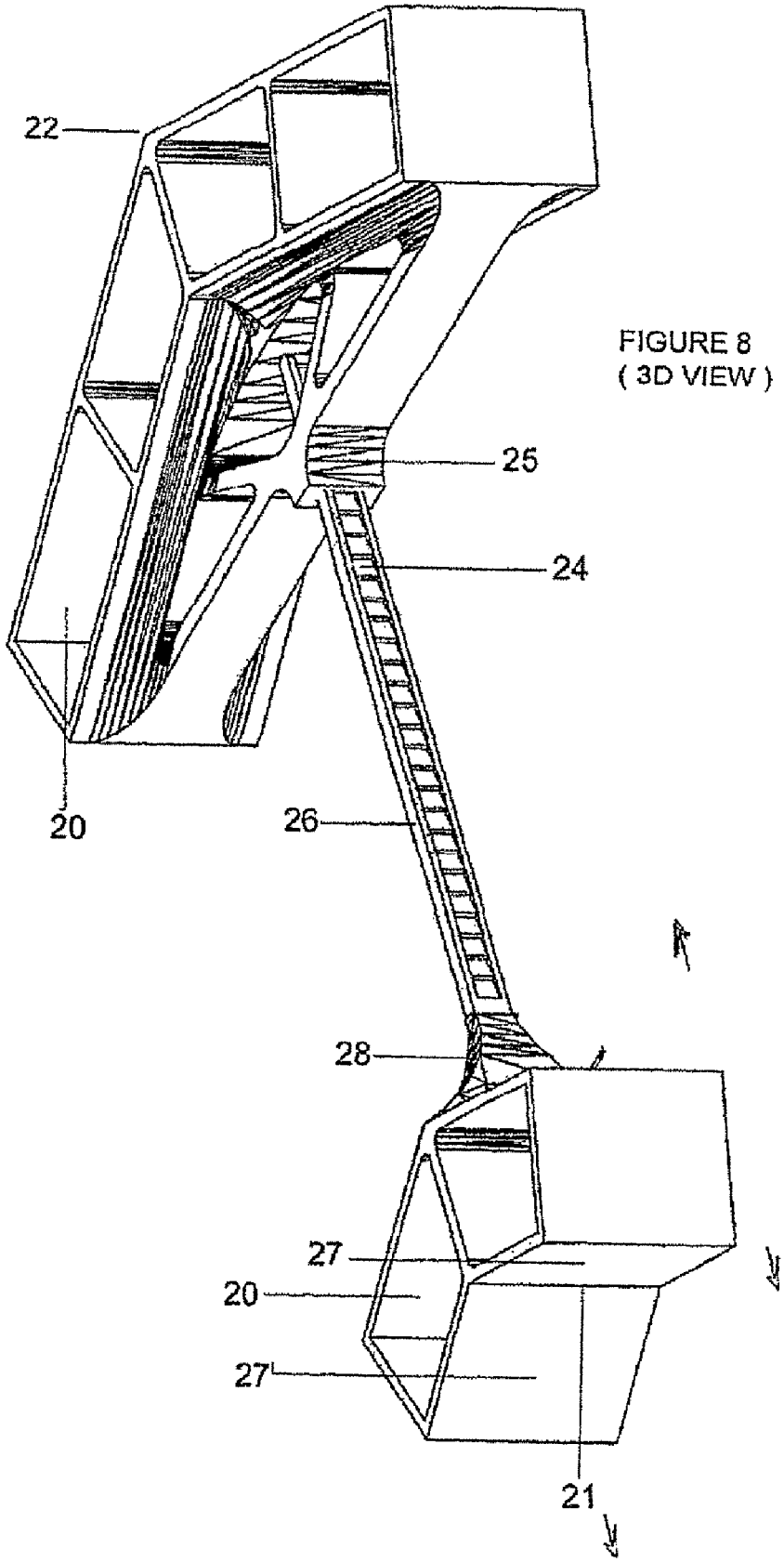
FIG. 8 presents a perspective drawing of the folded variable angular tie of 135°
Figure 9:
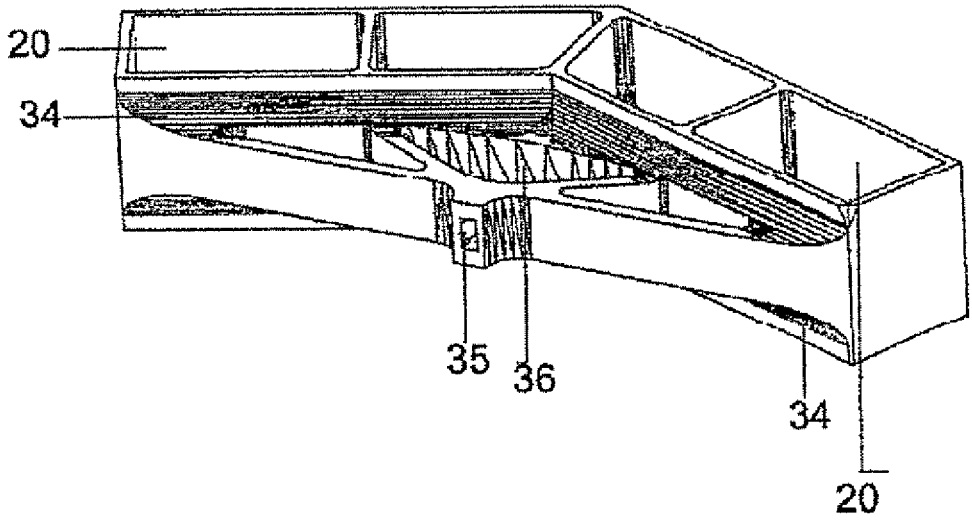
FIG. 9 presents a perspective drawing of the male and female part of the angular tie of 135°.
Figure 9:
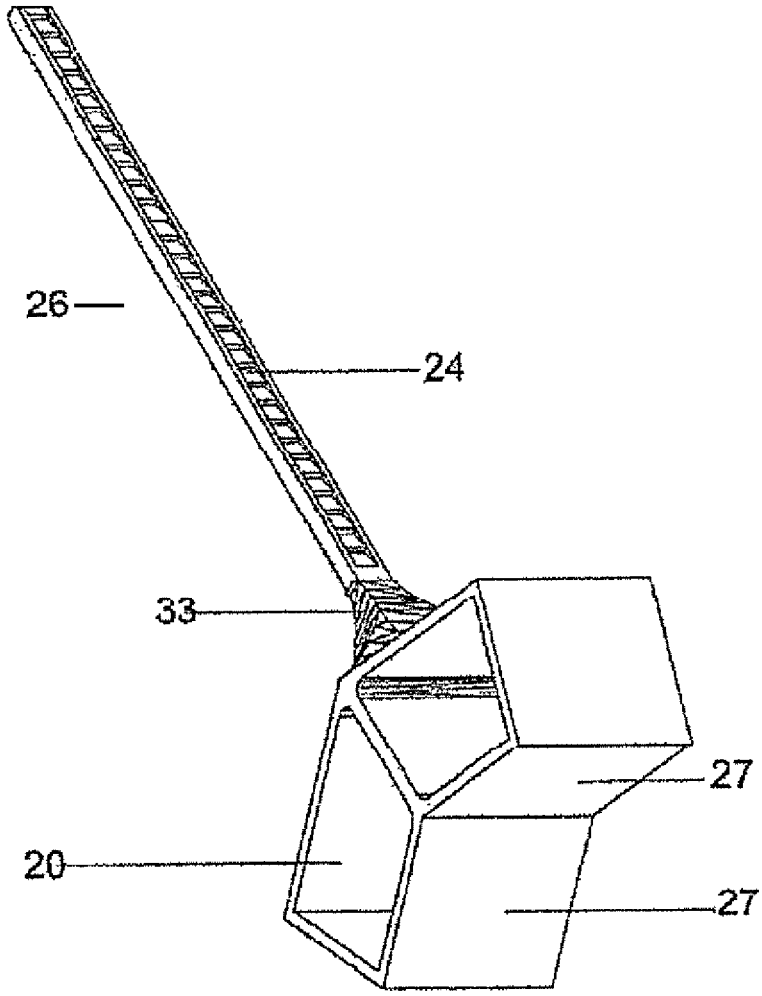
Figure 10:
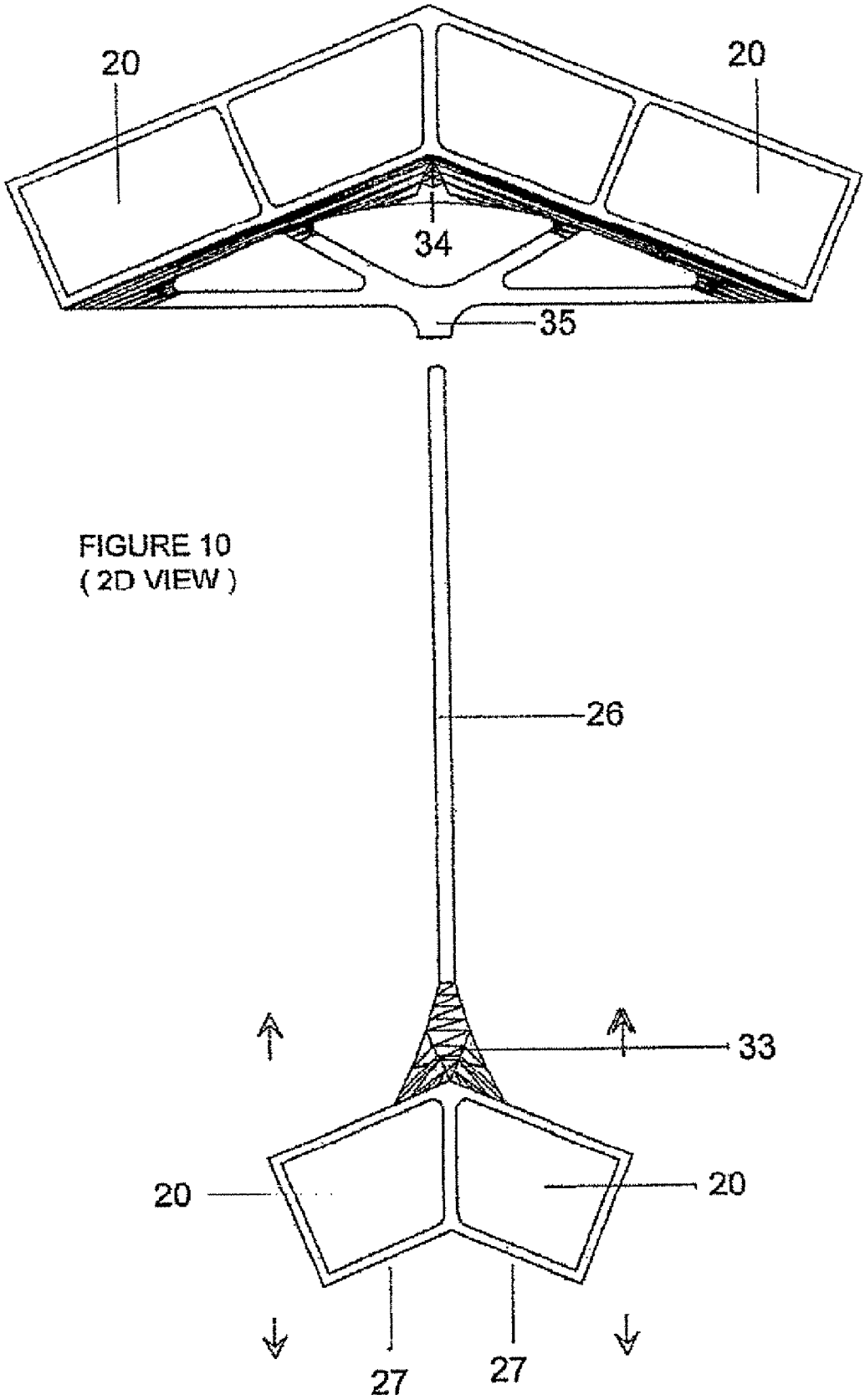
FIG. 10 presents the top-view of the male and female part of the angular tie of 135°.
Figure 11:
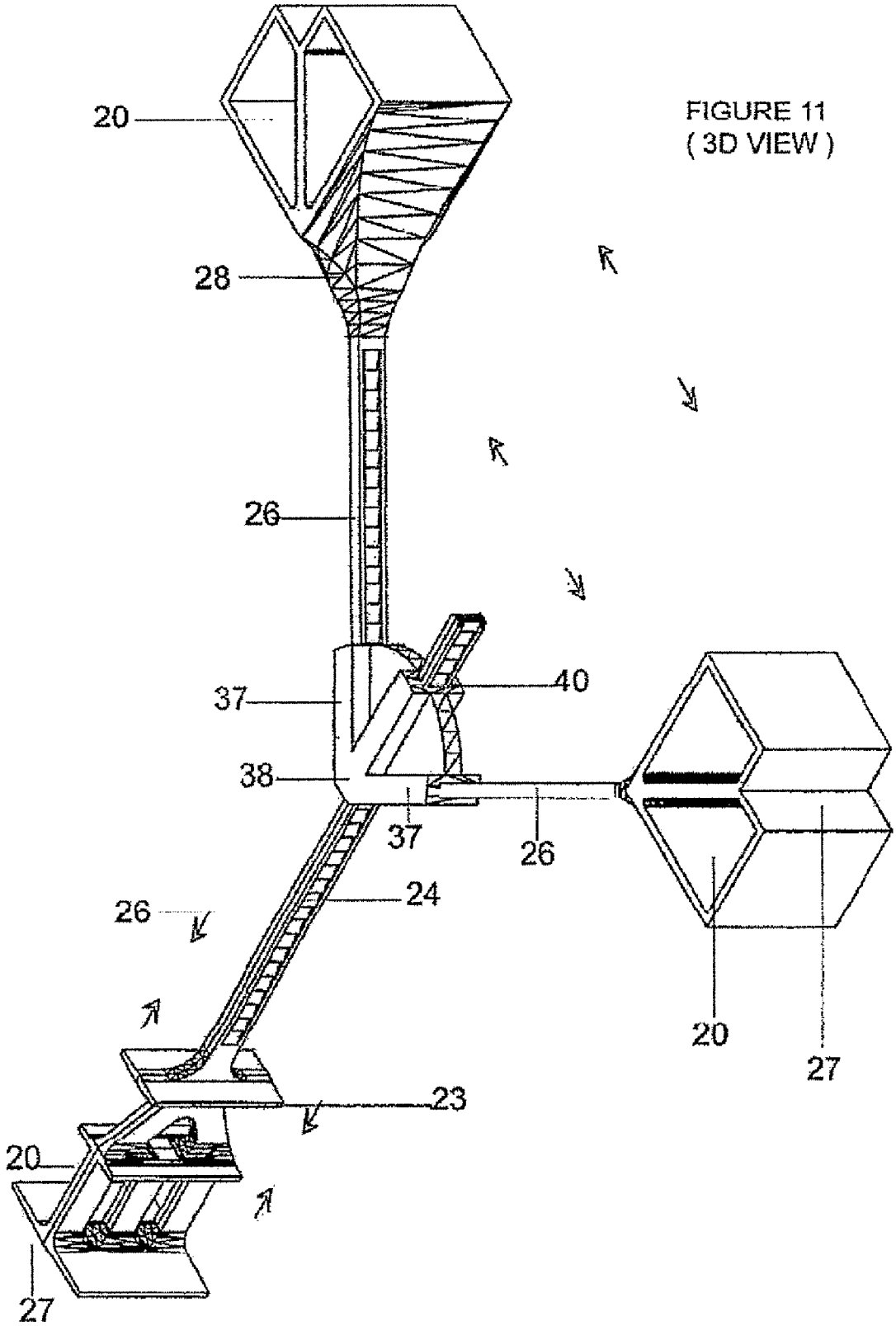
FIG. 11 presents a perspective drawing of the cross tie for different T-forms and wall spacing.
Figure 12:
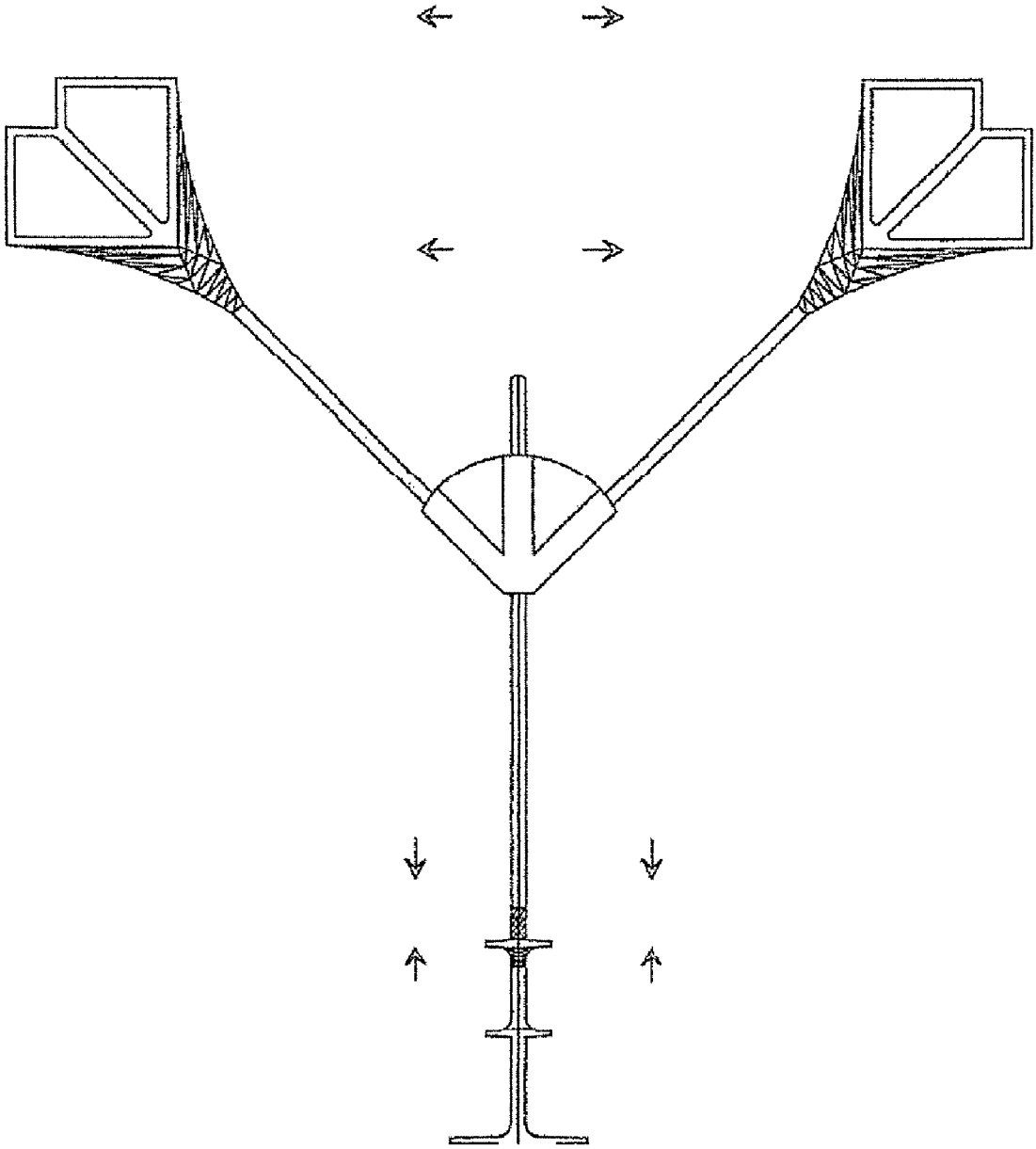
FIG. 12 presents the top-view of the cross tie for various T-forms and wall spacing.

Referring to FIG. 1 it can be seen that it presents straight tie (21), which can be adjusted to a necessary wall thickness by means of the female part of straight tie (22), if necessary. The firm connection of parts (21) and (22) is accomplished by means of lateral teeth on male part (24) and the teeth on female part of the tie (25), (30) and (35). In FIG. 4 the side view of the variable straight tie with the set lateral teeth can be seen. The tie carrier is dimensioned in such a way, that it might carry the weight of the mounting and that its lateral teeth (24) and (25) could endure all necessary tensile deformations, in accordance with this invention the variable ties can be used as the mounting carriers in the wall boarding, also the ribbed bars as well as the nets can be used. Also, the setting of the vertical boarding on the corners of the object is easier and faster. Distancing members (23) on the variable tie are placed on the regular distance from the wall and they are placed only on the variable straight tie. They serve exclusively to set the horizontal mounting on a regular distance between themselves and between the bars and the wall. It is important to mention that positions (20) on the variable tie and on the tie floor always make 6 cm, in order that they can enter into the insulation plate or the insulation lining. The little feet on the outer part of the variable tie and on the ties-floors (27) serve as the carriers of the plaster plates. Those are fastened by means of the screw and the plaster plate to the little feet in the wall, hi such a way there is a saving in the installing works, in providing of carriers and in setting the carriers of the plaster plates. As it is presented in FIG. 4, it can be seen that a various thickness can be set by means of a female part. The male parts of variable ties (FIG. 2, FIG. 6, FIG. 9) can be made in two variants, the first variant is for the wall span of 14 to 36 cm and the second one for the wall span of 36 to 60 cm. This variant is usable at building the foundations as well as the underground and ground floor carrying walls. The span measures are presented on the upper part of the neck of tie (26). The female parts of variable ties (22), (30) and (35) are dimensioned in a way to endure the tensile deformations at the thickest walls. The investigations and the attestations of the ties are carried out on the Civil Engineering Institute in Zagreb. They have satisfied by its strength and carrying capacity, but also by the firm connection of the male and female part of the variable tie, FIGS. (1); (5); (8). FIG. 5 presents the variable angular ties of 90° that can also be set on a necessary distance. Also, this is achieved by means of position (30), where the way of the firm connection of the male and female part can be seen. The neck of tie (32) enters into the reinforced part of angular female tie (31). The reinforced part on the female part is presented by position (31). The reinforcements on the male part of tie (28) prevent the bending of the neck of male tie (28). The measures of span (26) are also impressed on the male part of the angular tie. FIG. 8 presents the variable angular tie of 135° that can also be set on a necessary distance. The firm connection is accomplished by fixing male and female part (35) by means of the lateral teeth on them. The tie male parts (33) and the tie female parts (34) are reinforced. The measures of wall span (26) are situated on the neck of the male angular tie of 135°. The position where insulation plates (20) enter and positions (27) that serve as the carriers of the plaster plates are presented. FIG. 11 presents the cross tie for the formation of the T-shape wall. Position (37) presents the positions on the cross tie, where the male angular ties of 90° enter. Position (38) presents the place where the male angular tie of 90° is fixed. On position (39) the position on the cross tie is presented, where the male straight tie enters, and on (40) the fixing position for the cross tie is presented. There is the possibility of the formation of various wall thicknesses by means of the cross tie. The insulation lining is presented in FIG. 13, its outer surface on which the mounting is placed and the liquid concrete is filled in. Position (46) presents the grooves on the insulation linings that serve for the firm connection of one along the other. This is accomplished by means of the ties-linings, FIG. 15, that enter on lateral wings (47) into grooves (46). In FIG. 14 the inner view of the insulation lining with cavities (44) and with rounded ribs that reinforce the wall of insulation lining (45) can be seen. The insulation lining is constructed in such a way, that lateral wings (47) are the boarding for the ribbed carrier of the reinforced concrete plate. While the upper side of insulation lining serves as the boarding for the A7B plate.

Figure 15:
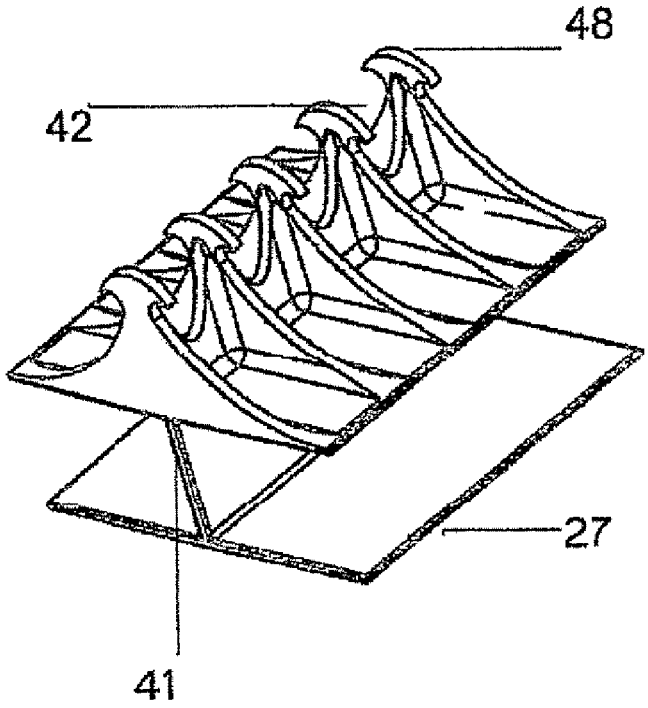
FIG. 15 presents a perspective drawing of the tie-floor for connecting the insulation lining to the reinforced concrete plate.
Figure 16:
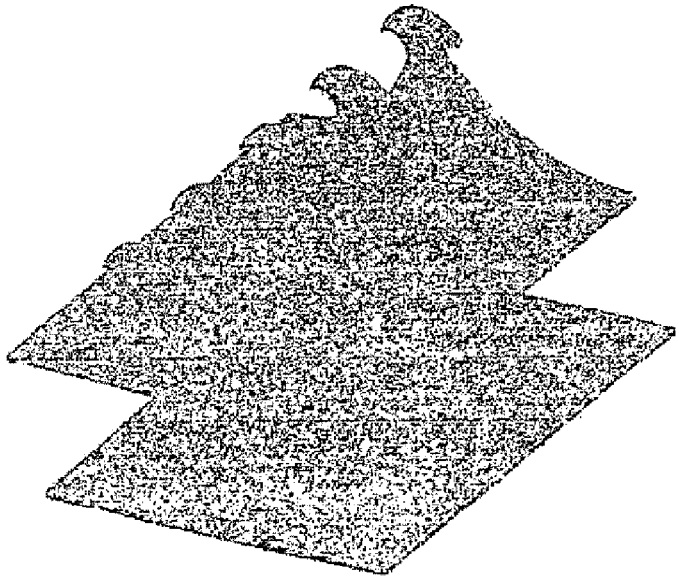
FIG. 16 presents a perspective view of the tie-floor for the insulation lining.
Figure 17:
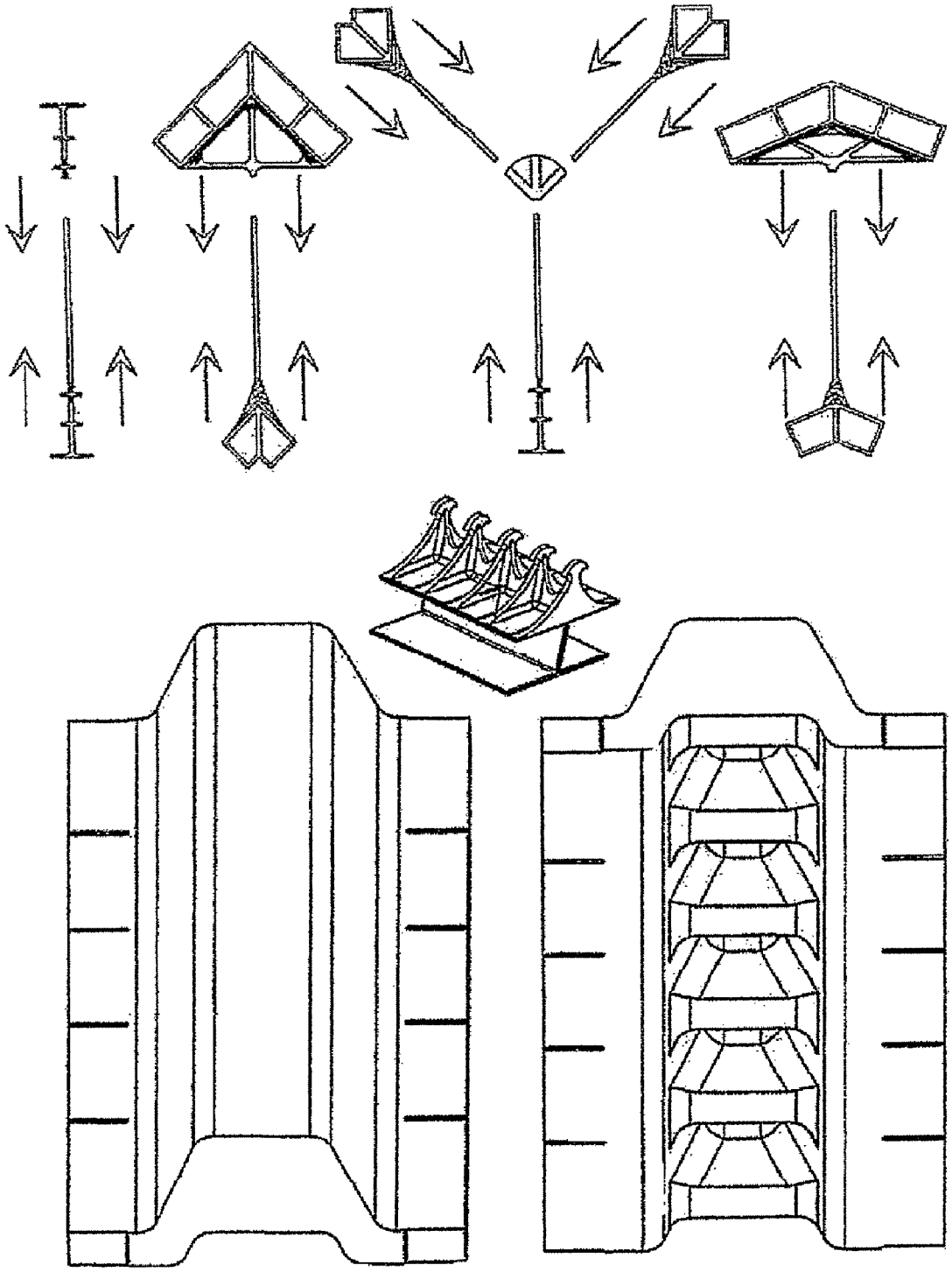
FIG. 17 presents the variable ties, the cross ties, the ties-linings and the insulation linings.
Figure 18:
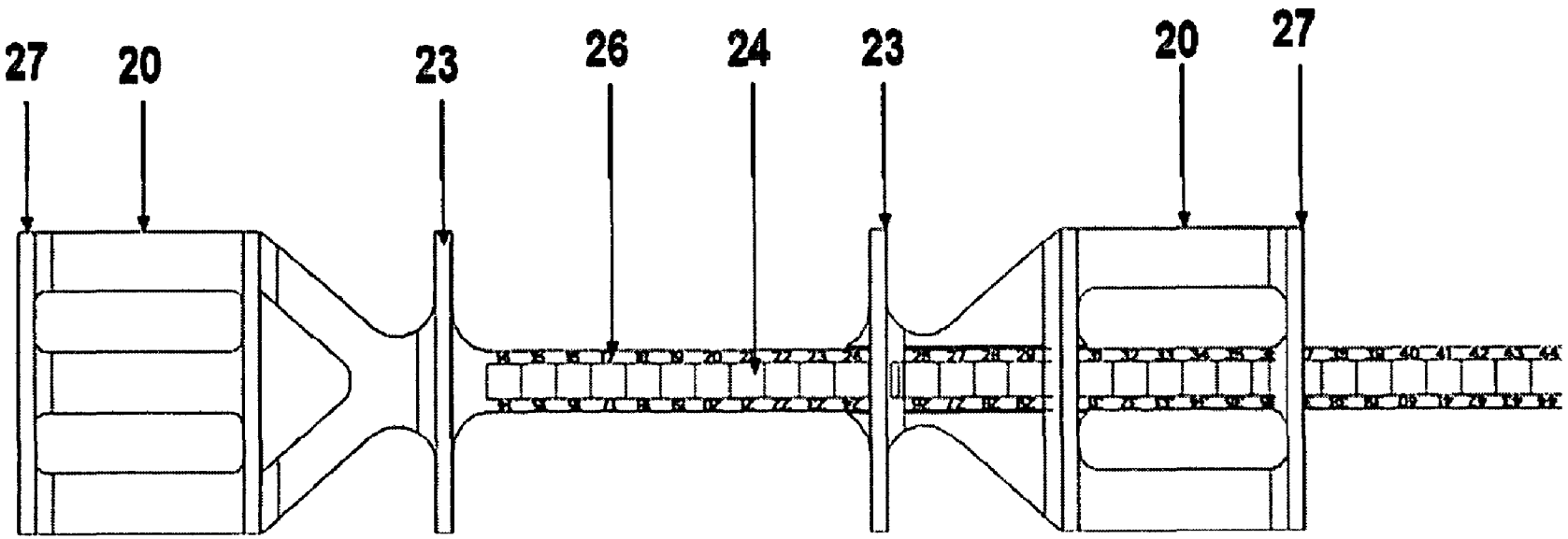
FIG. 18 is side view of a male and female part of a wall tie in accordance with the invention showing span measurements on the neck of the male part of the tie, and with associated sheet materials.
Figure 19:
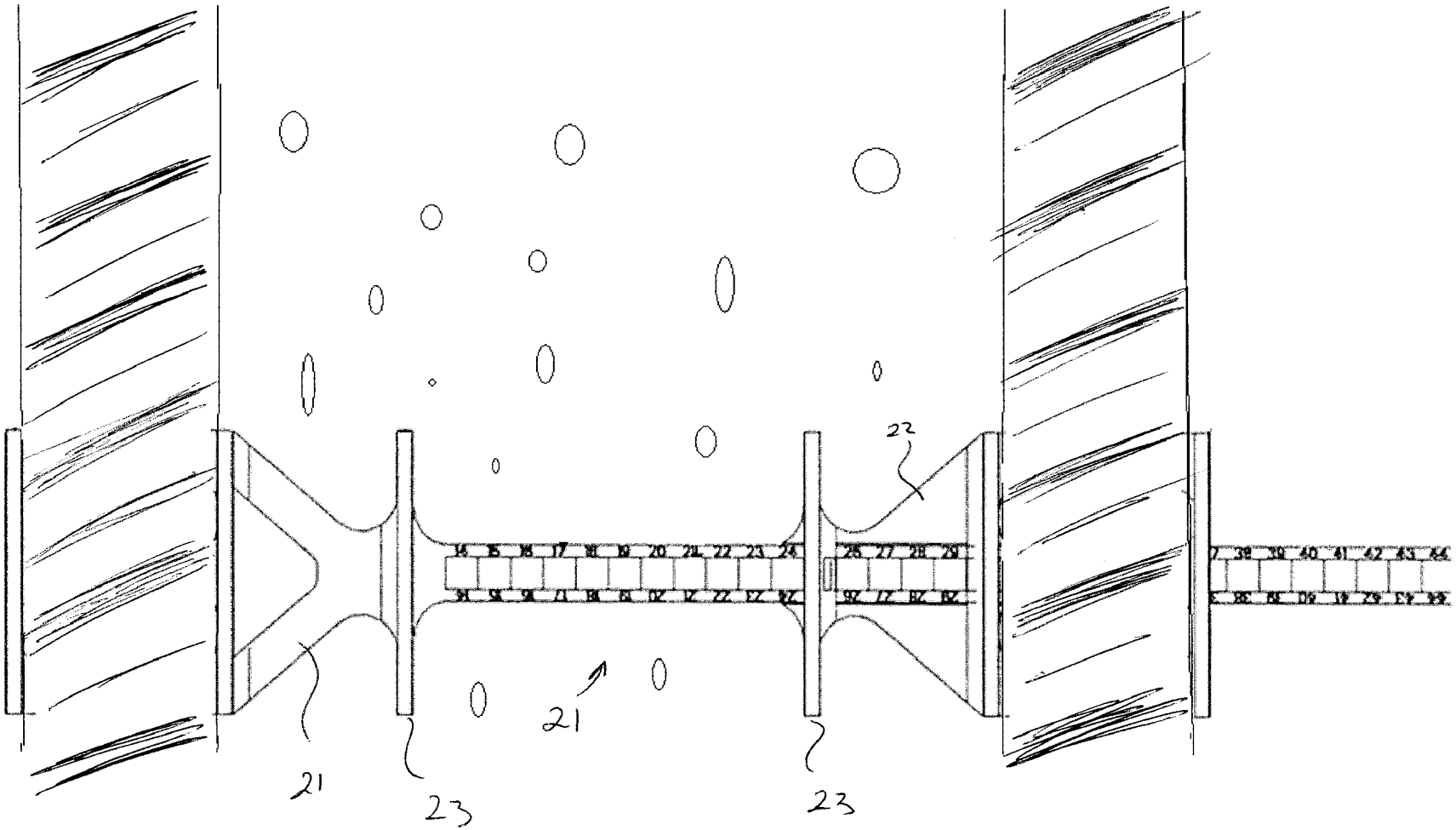
FIG. 19 is side view of male and female part of a wall tie in a accordance with the invention together with a plurality of sheet materials held in position thereby with concrete located between the sheet materials.

The tie-lining is presented in FIG. 15, and its characteristic appearance can be seen. Position (41) shows the position where the insulation lining enters and is fixed to the tie-lining. Position (42) presents the distancing member for setting the mounting of the carrier of the reinforced concrete plate on a regular distance. Position (48) presents the anchors for fixing the ties-linings into the reinforced concrete plate. Also, on the tie-lining positions (27) are presented, as well as the little feet of the plaster plates carrier.

What is claimed is:

1. A variable length plastic wall tie for connecting and separating sheet materials used in casting a concrete wall, comprising:

a male part and a female part of the wall tie, the male part having a body having two spaced apart flanges for receiving an insulating sheet, and having a distancing member spaced apart from said two spaced apart flanges and having a neck extending therefrom, said neck being axially slidable in said female part by fitting into an aperture in the female part of the tie, said neck of said male part having two generally parallel surfaces provided with a plurality of male teeth thereon; and wherein said aperture in the female part is provided with two pawls on opposite sides of said aperture, said pawls being positioned to engage with said male teeth of said neck to retain said male part a selected distance from female part, and the female part having two spaced apart flanges for receiving an insulating sheet, and having a distancing member spaced apart from said two spaced apart flanges, and the neck of the male part having wall thickness measurements indicated thereon, the separation of the male part and the female part being adjustable to provide a desired wall thickness by axial sliding movement of said neck of said male part in said aperture of said female part to a separation indicated by the wall thickness measurements.

2. The tie of claim 1, wherein said tie comprises one or more of 90° angled ties, 135° angled ties, and T-shape cross ties.

3. The tie of claim 1, wherein said ties are fabricated from polypropylene.

4. The tie of claim 1, wherein the separation of the male part and the female part is adjustable to provide a desired wall thickness of between 14 to 60 cm.

5. The tie of claim 1, wherein said tie comprises a straight tie.

6. The tie of claim 1, wherein said female part has a first set of two pawls located on opposite sides of said aperture, and a second set of two pawls axially separated from said first set of two pawls and on the same opposite sides of said aperture.

7. A wall assembly, comprising:

a plurality of sheet materials held in position by a plurality of variable length plastic wall ties, said wall ties each having a male part and a female part of the tie, the male part having a body having two spaced apart flanges for receiving an insulating sheet, and having a distancing member spaced apart from said two spaced apart flanges and having a neck extending therefrom, said neck having two generally parallel surfaces, and said two parallel surfaces are both provided with a plurality of male teeth thereon, said neck being axially slidable in an aperture in said female part by fitting into the aperture in the female part of the tie, said aperture in the female part having two pawls on opposite sides of said aperture, said pawls being positioned for ratcheting engagement with said male teeth of said neck to retain said male part a selected distance from the female part , the female part having two spaced apart flanges for receiving an insulating sheet, and having a distancing member spaced apart from said two spaced apart flanges and the neck of the male part having wall thickness measurements indicated thereon, the separation of the male part and the female part being adjustable to provide a desired wall thickness by axial sliding movement of said neck of said male part in said aperture of said female part to a separation indicated by the wall thickness measurements.

8. The wall assembly of claim 7, further comprising concrete located between the sheet materials.

9. The wall assembly of claim 7 wherein said ties comprise one or more of 90° angled ties, 135° angled ties, and T-shape cross ties.

10. The wall assembly of claim 7, wherein said sheet materials are foam insulation.

11. The wall assembly of claim 7, wherein the separation of the male part and the female part is adjustable to provide a desired wall thickness of between 14 to 60 cm.

12. The wall assembly of claim 7, wherein said tie comprises a straight tie.

13. The wall assembly of claim 7, wherein said female part has a first set of two pawls located on opposite sides of said aperture, and a second set of two pawls axially separated from said first set of two pawls and on the same opposite sides of said aperture.

14. A variable length plastic wall tie for connecting and separating sheet materials used in casting a reinforced concrete wall, comprising:

a male part having a body with three flanges extending therefrom, two of said flanges being axially separated a sufficient distance to receive and retain an insulation foam sheet material, and one of said flanges being a distancing member spaced apart from the other two flanges, and a neck extending from said body, said neck having two generally parallel surfaces, said two parallel surfaces being both provided with a plurality of male teeth thereon;

a female part having three flanges extending therefrom, two of said flanges being axially separated a sufficient distance to receive and retain an insulation foam sheet material, and one of said flanges being a distancing member spaced apart from the other two flanges, and an aperture shaped to receive said neck of said male part; said aperture having two opposing aperture walls provided with pawls adapted to engage said male teeth of said neck;

said neck being axially slidable in said aperture and female part by fitting into an aperture in the female part of the tie, said neck of said male part at least one side thereof, and said aperture in the female part being provided with one or more pawls for ratcheting engagement with said male teeth to hold said female part in position relative to said male part, and the neck of the male part having wall thickness measurements indicated thereon;

the separation of the male part and the female part being adjustable to provide a desired wall thickness by axial sliding movement of said neck of said male part in said aperture of said female part to a separation indicated by the wall thickness measurements.

15. The tie of claim 14, wherein said tie comprises a straight tie.

16. The tie of claim 14, wherein said tie comprise one or more of 90° angled ties, 135° angled ties, and T-shape cross ties.

17. The tie of claim 14, wherein said female part has a first set of two pawls located on opposite sides of said aperture, and a second set of two pawls axially separated from said first set of two pawls and on the same opposite sides of said aperture.

* * * * *